US006464318B2

(12) United States Patent
Kubo

(10) Patent No.: US 6,464,318 B2
(45) Date of Patent: Oct. 15, 2002

(54) RECORDING DEVICE CAPABLE OF ACCURATELY DETECTING TEMPERATURE OF RECORDING HEAD

(75) Inventor: Tomoyuki Kubo, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1 days.

(21) Appl. No.: 09/887,928

(22) Filed: Jun. 26, 2001

(65) Prior Publication Data

US 2002/0001003 A1 Jan. 3, 2002

(30) Foreign Application Priority Data

Jun. 29, 2000 (JP) ..... 2000-195746

(51) Int. Cl.[7] ..... B41J 2/365; B41J 29/393

(52) U.S. Cl. ..... 347/17; 347/19; 347/194

(58) Field of Search ..... 347/14, 17, 19, 347/189, 191, 194, 192

(56) References Cited

U.S. PATENT DOCUMENTS 5,485,182 A * 1/1996 Takayanagi et al. ..... 347/17
5,760,797 A * 6/1998 Koizumi et al. ..... 347/14
5,975,669 A * 11/1999 Ohshima ..... 347/14
6,024,430 A * 2/2000 Koitabashi et al. ..... 347/17

FOREIGN PATENT DOCUMENTS

JP A 3-140248 6/1991

* cited by examiner

*Primary Examiner*—John Barlow
*Assistant Examiner*—Blaise Mouttet
(74) *Attorney, Agent, or Firm*—Oliff & Berridge, PLC

(57) ABSTRACT

The invention provides a recording device capable of accurately detecting the temperature of a recording head that stops a recording operation at a maximum temperature regardless of the unevenness in the temperature characteristics of voltage drop in the forward direction of a first sensor. The invention has a driving circuit for driving a recording head. The temperature of the driving circuit is detected by the first sensor by utilizing the temperature characteristics of voltage drop in the forward direction of the first sensor. When a recording device is turned ON, a room temperature and an output voltage of the first sensor are stored in a memory. The invention also has a calculation unit that performs a calculation to obtain a voltage value that the first sensor will output at a predetermined maximum temperature, based on the room temperature and the output voltage stored in the memory. When an output from the first sensor reaches the output value calculated by the calculation unit, then the control circuit stops the recording operation.

9 Claims, 3 Drawing Sheets

RECORDING DEVICE CAPABLE OF ACCURATELY DETECTING TEMPERATURE OF RECORDING HEAD

BACKGROUND OF THE INVENTION

1. Field of the Invention

The present invention relates to a recording device for recording on a recording medium by using a recording head.

2. Related Art

A conventional recording device includes a sensor for detecting temperature of a recording head or of a driving circuit that drives the recording head. When the temperature exceeds a predetermined temperature, the recording operation is either stopped or slowed down, thereby protecting the recording head and the driving circuit from overheating.

Japanese Patent Application Publication (Kokai) No. HEI-3-140248 discloses a diode serving as a sensor for detecting temperature of a heater, which heats up ink in an ink jet head, by utilizing its temperature characteristics of voltage drop in the forward direction. As shown in FIG. 3, the voltage drop in the forward direction is in inverse proportion to the temperature, and its relation curve TS forms a substantially straight line.

However, voltages output in response to temperature differ by a relatively large amount A among products. Therefore, when a voltage E1 is set for a voltage at, for example, 125° C. so as to stop recording operations at 125° C., the voltage E1 may be output before the temperature reaches 125° C., or may not be output even when the temperature exceeds 125° C. When the voltage E1 is output before reaching 125° C., the recording operation will be unnecessarily stopped. For example, even when the recording device has capability to continuously perform the recording operation on a large number of pages, the recording operation will be stopped when the operation is performed on only a few pages. On the other hand, when the temperature exceeds 125° C. without the voltage E1 being output, the driving circuit may be damaged due to overheating.

SUMMARY OF THE INVENTION

It is an objective of the present invention to overcome the above problems, and also to provide a recording device capable of accurately and reliably controlling its operation based on temperature regardless of unevenness in temperature characteristics of voltage drop in the forward direction.

In order to achieve the above and other objectives, there is provided a recording device including a recording element, a drive circuit, a first sensor, a memory, a calculation unit, and a control circuit. The drive circuit drives the recording element. The first sensor outputs a signal corresponding to a temperature around at least one of the recording element and the drive circuit. The memory stores a first data corresponding to a first temperature. The first data relates to a first signal output by the first sensor at the first temperature. The calculation unit obtains a data relating to the signal in accordance with the first data stored in the memory. The control circuit regulates the drive circuit to drive the recording element when the data obtained by the calculation unit corresponds to a predetermined second temperature higher than the first temperature.

There is also provided a recording device including a recording element, a driving circuit, a sensor, a calculation unit, and a control circuit. The driving circuit drives the recording element. The sensor outputs a voltage corresponding to a temperature around at least one of the recording element and the driving circuit. The sensor has temperature characteristics of voltage drop in forward direction. The memory stores a first data corresponding to a first temperature. The first data relating to both a coefficient of a relation curve of the temperature characteristics and a first voltage output by the sensor at the first temperature. The calculation unit obtains a second data relating to the voltage in accordance with the first data stored in the memory.

PREFERRED EMBODIMENTS OF THE PRESENT INVENTION

Recording devices according to embodiments of the present invention will be described while referring to the accompanying drawings.

Figure 1:
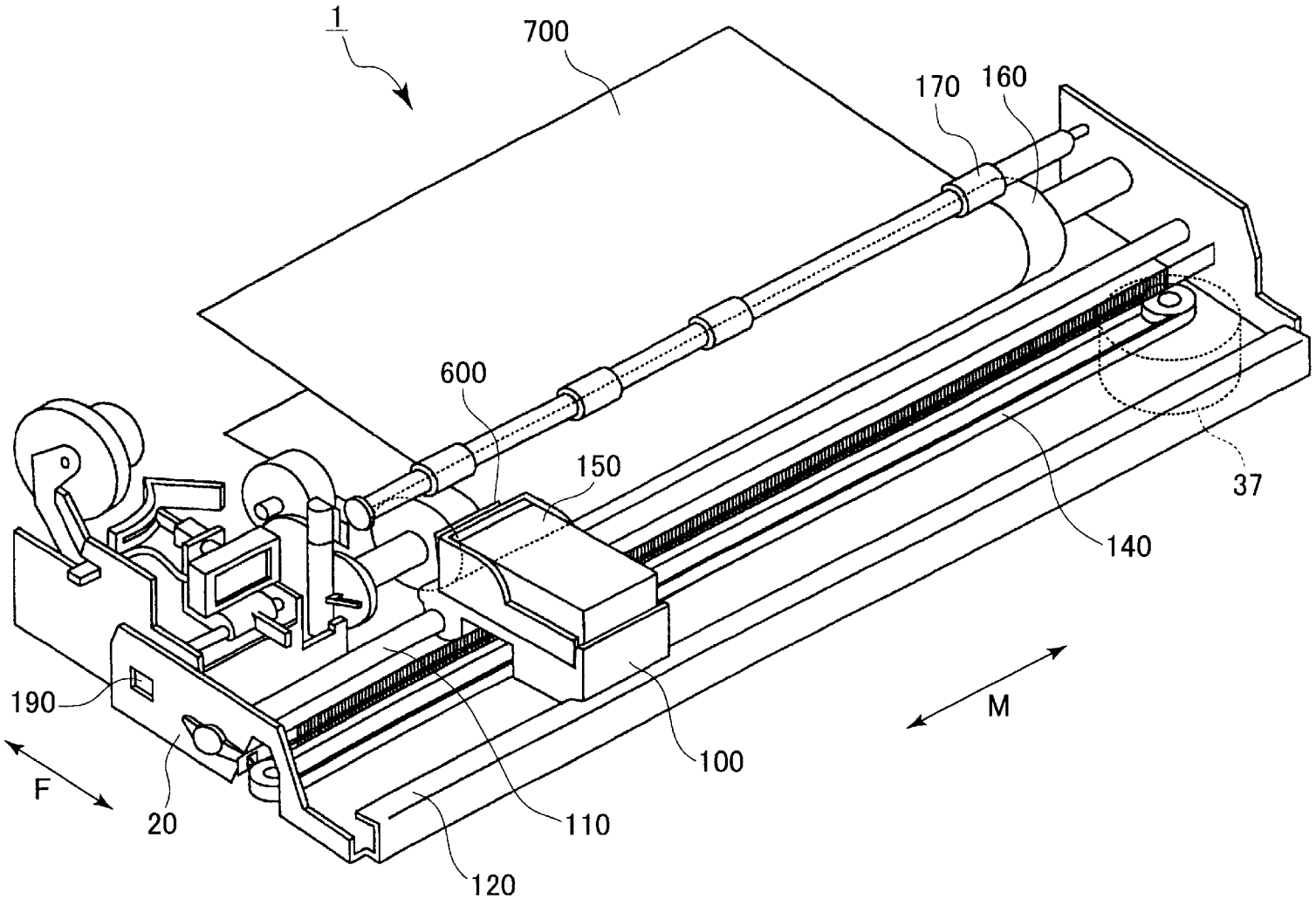
FIG. 1 is a perspective view showing an internal configuration of a recording device according to a first embodiment of the present invention.

As shown in FIG. 1, a recording device 1 according to a first embodiment of the present invention includes an ink-jet-type head unit 600 detachably mounted on a carriage 100 within a main body 20. The carriage 100 is supported on a pair of guide bars 110, 120 both extending in a main scanning direction M. A belt 140 transmits the driving force from a motor 37 to the carriage 100, so the carriage 100 reciprocally moves along the guide bars 110, 120 with the head unit 600 mounted thereon. A tank 150 is detachably mounted on the carriage 100. The tank 150 stores ink, and supplies the ink to the head unit 600. A pair of feed rollers 160, 170 transport a recording sheet 700 in a sheet feed direction F perpendicular to the main scanning direction M. A power switch 190 is controlled turned ON and OFF. When the power switch 190 is turned ON, a 5V voltage is applied to the head unit 600.

Figure 2:
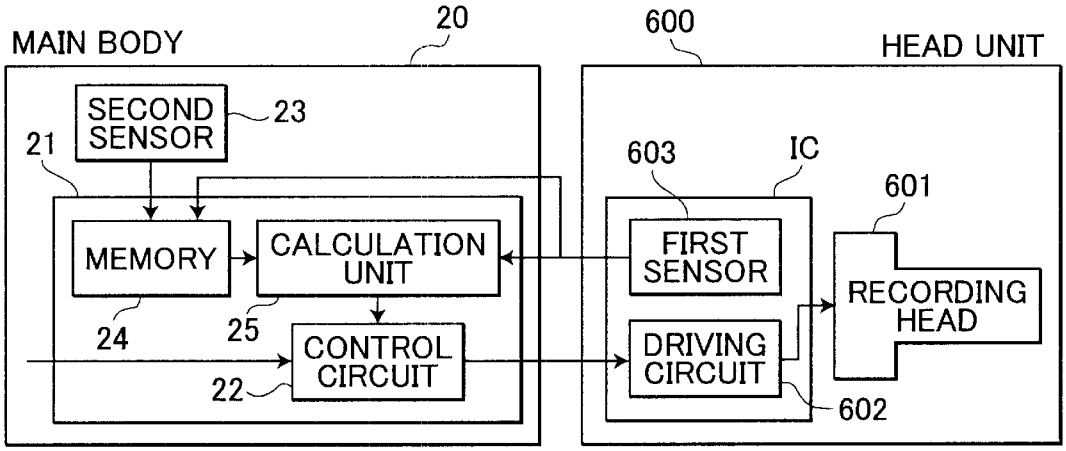
FIG. 2 is a block diagram showing an electrical configuration of the recording device.

FIG. 2 is a block diagram showing an electrical configuration of the recording device 1. As shown in FIG. 2, the head unit 600 includes a recording head 601, a driving circuit 602, and a first sensor 603. The driving circuit 602 generates a driving voltage based on a control signal for driving the recording head 601. The first sensor 603 is integrally formed with the driving circuit 602, and is made from a diode formed on silicon of the driving circuit 602. The first sensor 603 outputs a voltage based on temperature of the driving circuit 602. Because the first sensor 603 and the driving circuit 602 are together formed as an integrated circuit, the first sensor 603 can detect the direct temperature of the driving circuit 602. It should be noted that the first sensor 603 may output the voltage based on the temperature around both or at least one of the recording head 601 and the driving circuit 602 rather than the direct temperature of only the driving circuit 602.

It is preferable that the recording head 601 be a type of performing recording operation on the recording sheet 700 in a dot-metrics method by selectively driving a large number of actuators. The recording head 601 may be of a thermal type or dot-impact type rather than an ink-jet type.

The main body 20 includes a circuit board 21, a control circuit 22 mounted on the circuit board 21, a second sensor 23, a memory 24, and a calculation unit 25. The control circuit 22 detects recording data transmitted from an external unit (not shown) and outputs the control signal to the driving circuit 602, thereby controlling the driving circuit 602 to drive the recording head 601. The second sensor 23 detects a room temperature when the power switch 190 is turned ON. The memory 24 stores the room temperature and also a voltage output from the first sensor 603 at the room temperature. During the recording operation, the calculation unit 25 performs calculation based the voltage output from the first sensor 603 and the room temperature stored in the memory 24 in a manner described later. Then, the calculation unit 25 notifies the control circuit 22 when the temperature of the driving circuit 602 has reached a predetermined maximum temperature, under which the driving circuit 602 can operate without being damaged due to overheating. The control circuit 22 controls, stops for example, the recording-head-driving of the driving circuit 602 based on the notice from the calculation unit 25.

The control circuit 22, the memory 24, the calculation unit 25 are configured from combinations of well-known central processing unit (CPU), a read only memory (ROM), a random access memory (RAM), and a hard circuit. Although not shown in the drawings, a signal line for transmitting signals from the control circuit 22 to the driving circuit 602 and a signal line for transmitting signals from the first sensor 603 to the main body 20 are formed from a well-known flexible print circuit cable.

Figure 3:
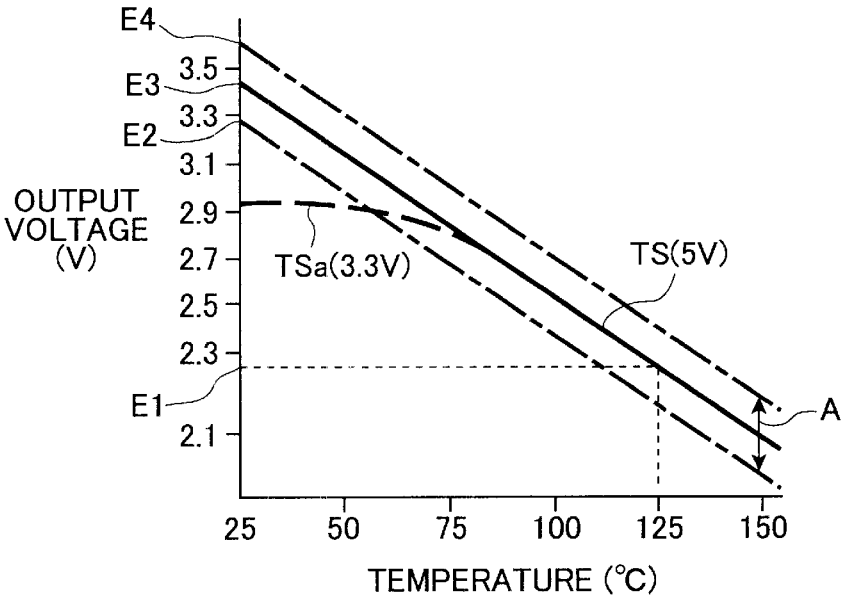
FIG. 3 is a graph showing temperature characteristics of voltage drop in the forward direction of a temperature detecting unit of the recording device.

The second sensor 23 includes a thermostat, posistor, and the like, and is capable of outputting an accurate voltage corresponding to temperature. The first sensor 603 is formed from a diode as described above, and outputs a voltage corresponding to temperature. The voltage output from the first sensor 603 is determined by its temperature characteristics of voltage drop in the forward direction, which is shown in FIG. 3. As shown in FIG. 3, the output voltage from the first sensor 603 is in inverse proportion to temperature, and its relation curve TS forms a substantially straight line. However, the temperature characteristics of the voltage drop usually vary by a relatively large amount A (unevenness A) among products as described above.

According to the present embodiment, the unevenness A in the temperature characteristics among products is adjusted in a following manner.

That is, when the power switch 190 is turned ON, the second sensor 23 detects a room temperature, and the room temperature is stored in the memory 24. At the same time, a voltage output from the first sensor 603 at the room temperature is also stored in the memory 24. The room temperature may be 25° C., and the voltage at the room temperature may be E2, E3, or E4, for example.

Although the temperature characteristics differ among products, inclination of the relation of curve TS is the same among the products as shown in FIG. 3. Therefore, a voltage y output from the first sensor 603 at the maximum temperature x is obtained by a following equation:

$$y=B-k(x-T)$$

wherein:

B is an output voltage (V) of the first sensor 603 at the room temperature;

k is an inclination (coefficient) of the relation curve TS;

x is the maximum temperature (° C.) of the first sensor 603, i.e., of the driving circuit 602, 125° C. for example;

T is the room temperature (° C.), 25° C. for example, and y is an output voltage (V) that the first sensor 603 will output at the maximum temperature x.

It should be noted that the coefficient k has been obtained beforehand for the specific first sensor 603, and is presorted in the memory 24.

In this way, the output voltage y that the first sensor 603 will output when the temperature of the driving circuit 602 reaches the maximum temperature x is accurately obtained regardless of the unevenness A. Therefore, when the maximum temperature x is set to 125° C., for example, the output voltage of the first sensor 603 will drop to the output voltage y at 125° C., and the recording-head-driving of the driving circuit 602 will be stopped.

The above calculation is performed by the calculation unit 25. Needless to say, even when the room temperature T at the time of when the power switch 190 is turned ON is not 25° C., the calculation unit 25 can easily calculate the output voltage y because the coefficient k is constant.

It should be noted that the memory 24 can store, instead of the room temperature and the output voltage at the room temperature, a coefficient relating to a combination of the room temperature T and the output voltage B at the room temperature T. The coefficient may be a value used for adjusting the unevenness A in the temperature characteristics, for example, and will be obtained by the calculation unit 25 performing a predetermined calculation. Also, when the room temperature is known, for example when the output value y at the time of when the recording device 1 is turned ON is measured in an environment with a constant room temperature, there is no need to store the room temperature in the memory 24 each time when measuring the output value y. However, in this case also, data on the room temperature is prestored in the memory 24.

When the head unit 600 is exchanged, the temperature characteristics of the first sensor 603 will change. In this case also, the output voltage y corresponding to the maximum temperature x can be easily obtained from the above equation, so the operation of the driving circuit 602 can be reliably controlled when its temperature reaches the maximum temperature x based on the output from the first sensor 603.

Although the driving circuit 602 is used with a 5V power source in the above-described first embodiment, there has been used a lower voltage in recent years, so the head unit 600 including the first sensor 603 may be used with a lower voltage, such as 3.3V for example. In this case, as indicated by a dotted line in FIG. 3, a relation curve TSa of the temperature characteristics of the voltage drop does not form a straight line near the room temperature. Accordingly, the voltage value y corresponding to the maximum temperature x cannot be obtained in the above described manner.

A second embodiment of the present invention overcomes this problem. A recording device 1A according to the second embodiment will be described next while referring to FIGS. 4 and 5. It should be noted that components similar to that of the first embodiment are assigned with the same numberings and their explanation will be omitted here in order to avoid duplication in explanation.

Figure 4:
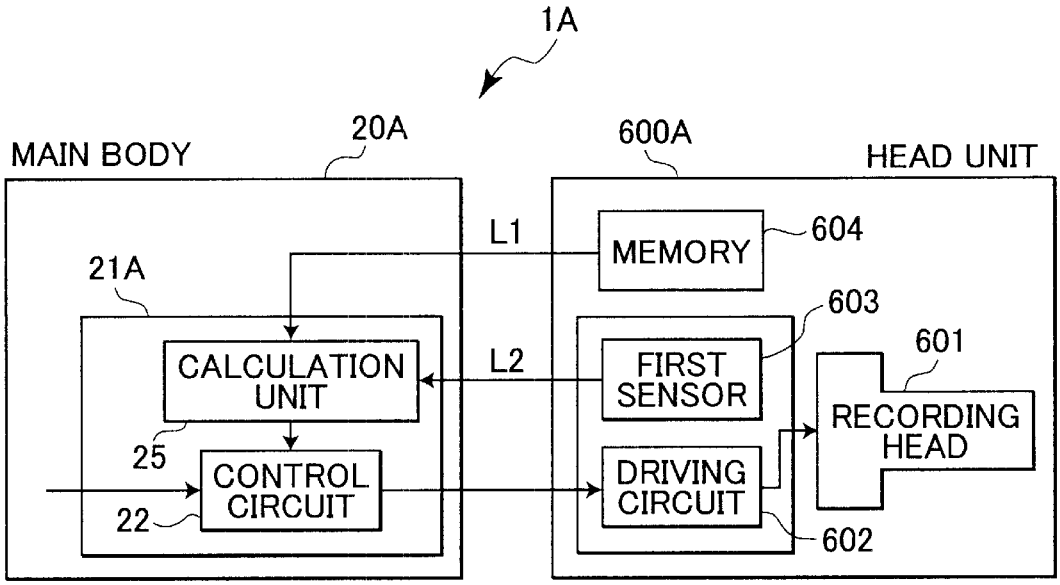
FIG. 4 is a block diagram showing an electrical configuration of a recording device according to a second embodiment of the present invention.
Figure 5:
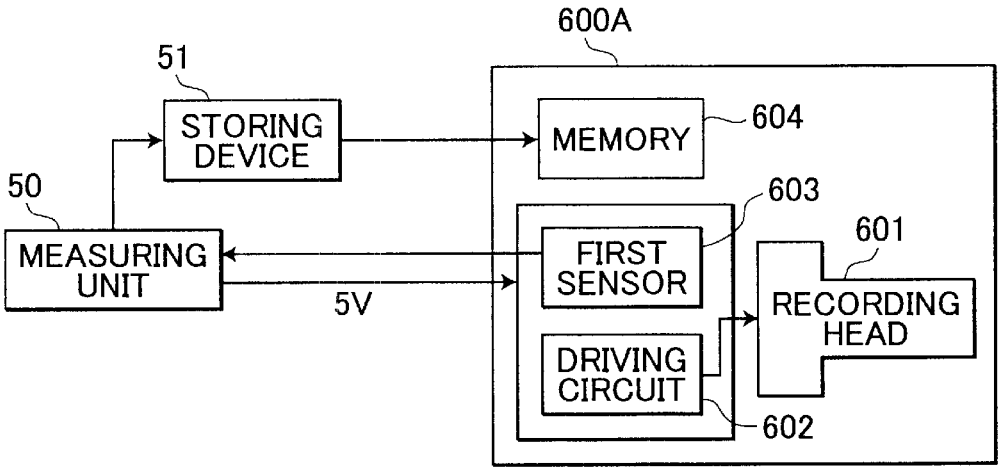
FIG. 5 is an explanatory view showing a manufacturing process of the recording device of FIG. 4.

In the second embodiment, as shown in FIG. 4, a head unit 600A includes a memory 604 in addition to the first sensor 603, the driving circuit 602, and the recording head 601. The memory 604 is a non-volatile memory, such as an EEPROM. A voltage of the first sensor 603 at a predetermined room temperature is prestored in the memory 604 in a following manner. That is, as shown in FIG. 5, the recording device 1A is placed in a room maintained at 25° C., and 5V voltage is applied to the first sensor 603. Then, an external measuring unit 50 measures an output voltage of the first sensor 603. An external storing device 51 stores the measured output voltage into the memory 604. Because these operations are performed at a production plant, temperature of 25° C. can be easily maintained during the measurement. Because the room temperature during the measurement is known to be, for example, 25° C., data on the predetermined room temperature is prestored in the memory 604. Therefore, there is no need to store the room temperature into the memory 604 at this time. However, the room temperature can be stored in the memory 604 as needed.

It should be noted that although the first sensor 603 of the second embodiment is applied with 3.3V voltage during the recording operation rather than 5V voltage, the first sensor 603 is configured tolerable with 5V voltage without being damaged.

After the head unit 600A with the memory 604 storing the voltage for the predetermined room temperature is mounted onto the main body 20A, then output signal lines L1, L2 extending from the first sensor 603 and the memory 604 are connected to the calculation unit 25 of the main body 20A.

In this condition, the driving circuit 602 is applied with 3.3V voltage, rather than 5V voltage. In this case, as described above, the relation curve TSa indicating the temperature characteristics of the voltage drop in the forward direction does not form a straight line around the room temperature. However, the relation curve TSa forms a substantially straight line near the maximum temperature x, 125° C. for example. Therefore, the calculation unit 25 can calculate the output value y for the maximum temperature x using the above equation based on the voltage at the predetermined room temperature that is prestored in the memory 604. Accordingly, during the recording operation, the calculation unit 25 outputs a signal based on the output from the first sensor 603, which accurately reflects the temperature of the driving circuit 602. Then, based on the signal from the calculation unit 25, the control circuit 22 stops sending signals to the driving circuit 602, thereby controlling the driving circuit 602 to stop driving the recording head 601.

In the second embodiment also, even when the head unit 600A is replaced, the voltage value y of the first sensor 603 at the maximum temperature x is easily obtained. Therefore, the operation of the driving circuit 602 can be stopped at the maximum temperature x regardless of unevenness A in the temperature characteristics.

As described above, according to the present invention, even when the sensors 603 have unevenness A in their temperature characteristics of the voltage drop in the forward direction, the operation of the recording head 601 or the driving circuit 602 can be controlled in an accurate manner when the maximum temperature is reached.

Also, because the first sensor 603 is provided to the head unit 600, 600A, when the head unit 600, 600A is replaced, the first sensor 603 also is replaced. Therefore, there is no need to make any rearrangement at the main body 20, 20A side in relation to unevenness in characteristics of the first sensor 603.

Because the memory 604 of the second embodiment is also mounted on the head unit 600A, the memory 604 is replaced at the time of when the head unit 600A is replaced. Therefore, there is no need to change stored data at the replacement of the head unit 600A.

While some exemplary embodiments of this invention have been described in detail, those skilled in the art will recognize that there are many possible modifications and variations which may be made in these exemplary embodiments while yet retaining many of the novel features and advantages of the invention.

For example, although specific values of temperature, voltage, and the like are mentioned in the above embodiments, the present invention is not limited thereto.

Also, in the first and the second embodiments, the operation of the recording head 601 is stopped when the temperature has reached the maximum temperature. However, the recording operation can be controlled in different manners so as to reduce recording amount in a time unit, thereby reducing generation of heat. For example, the number of dots recorded in a single scan may be reduced. In this case, dots unrecorded in a previous scan may be formed in a subsequent scan. Alternatively, recording in both scanning direction may be switched to recording in only one scanning direction.

What is claimed is:

1. A recording device comprising:

a recording element;

a drive circuit that drives the recording element;

a first sensor that outputs a signal corresponding to a temperature around at least one of the recording element and the drive circuit;

a power switch that is turned ON and OFF, wherein when the power switch is ON, one of a first driving voltage and a second driving voltage lower than the first driving voltage is applied to the first sensor, wherein the first sensor outputs a first signal corresponding to a first temperature when the first sensor is applied with the first driving voltage;

a memory that stores a first data relating to the first signal;

a calculation unit that obtains data relating to the signal in accordance with the first data stored in the memory, the signal being output when the first sensor is applied with the second driving voltage; and a control circuit that regulates the drive circuit to drive the recording element when the data obtained by the calculation unit corresponds to a predetermined second temperature higher than the first temperature.

2. The recording device according to claim 1, wherein, the first sensor has temperature characteristics of voltage drop where a relation curve between the temperature and the voltage drop forms a substantially straight line in a temperature region between the first temperature and a predetermined second temperature.

3. The recording device according to claim 2, further comprising a carriage that reciprocally moves along a surface of a recording medium, wherein the recording element, the driving circuit, and the first sensor are mounted on the carriage.

4. The recording device according to claim 2, wherein the first sensor outputs a first voltage as the first signal, and the first data relates to the first voltage.

5. The recording device according to claim 4, wherein the first data further relates to the first temperature.

6. The recording device according to claim 2, wherein the first data relates to a coefficient relating to the relation curve.

7. The recording device according to claim 6, wherein the coefficient is calculated by the calculation unit.

8. The recording device according to claim 1, further comprising a carriage that reciprocally moves along a surface of a recording medium, wherein the recording element, the driving circuit, and the first sensor are mounted on the carriage.

9. The recording device according to claim 1, wherein the first sensor outputs a second signal corresponding to the first temperature when the first sensor is applied with the second driving voltage, the second signal differing from the first signal.

* * * * *